United States Patent [19]

Massariolo

[11] Patent Number: 4,763,501

[45] Date of Patent: Aug. 16, 1988

[54] PUNCH-PROBING DEVICE ON A CROSS TRANSFER PRESS

[75] Inventor: Maffeo Massariolo, Therwil, Switzerland

[73] Assignee: Hatebur Umformmaschinen AG, Reinach, Switzerland

[21] Appl. No.: 874,492

[22] Filed: Jun. 16, 1986

[30] Foreign Application Priority Data

Jun. 24, 1985 [CH] Switzerland ..... 2681/85

[51] Int. Cl.[4] ..... B21D 55/00

[52] U.S. Cl. ..... 72/26; 72/4; 72/342; 72/12

[58] Field of Search ..... 72/444, 3, 4, 10, 11, 72/12, 26, 342, 344, 349, 404, 405

[56] References Cited

U.S. PATENT DOCUMENTS

| | | | |
|---|---|---|---|
| 2,699,252 | 1/1955 | Remington et al. | 72/3 |
| 4,202,191 | 5/1980 | Skinner | 72/10 |
| 4,308,734 | 1/1982 | Senft | 72/3 |
| 4,333,329 | 6/1982 | Richner | 72/3 |

*Primary Examiner*—David Jones

*Attorney, Agent, or Firm*—Ladas & Parry

[57] ABSTRACT

A punch probing device including at least one punch and a cooperating punch feeler. The feeler is operable to detect both foreign matter on the punch and damage of said punch. The feeler is moved perpendicularly into and out of operative engagement with the punch by means of a linkage parallelogram. Controls for the punch and linkage are provided.

10 Claims, 5 Drawing Sheets

PUNCH-PROBING DEVICE ON A CROSS TRANSFER PRESS

DESCRIPTION

Figure 1:
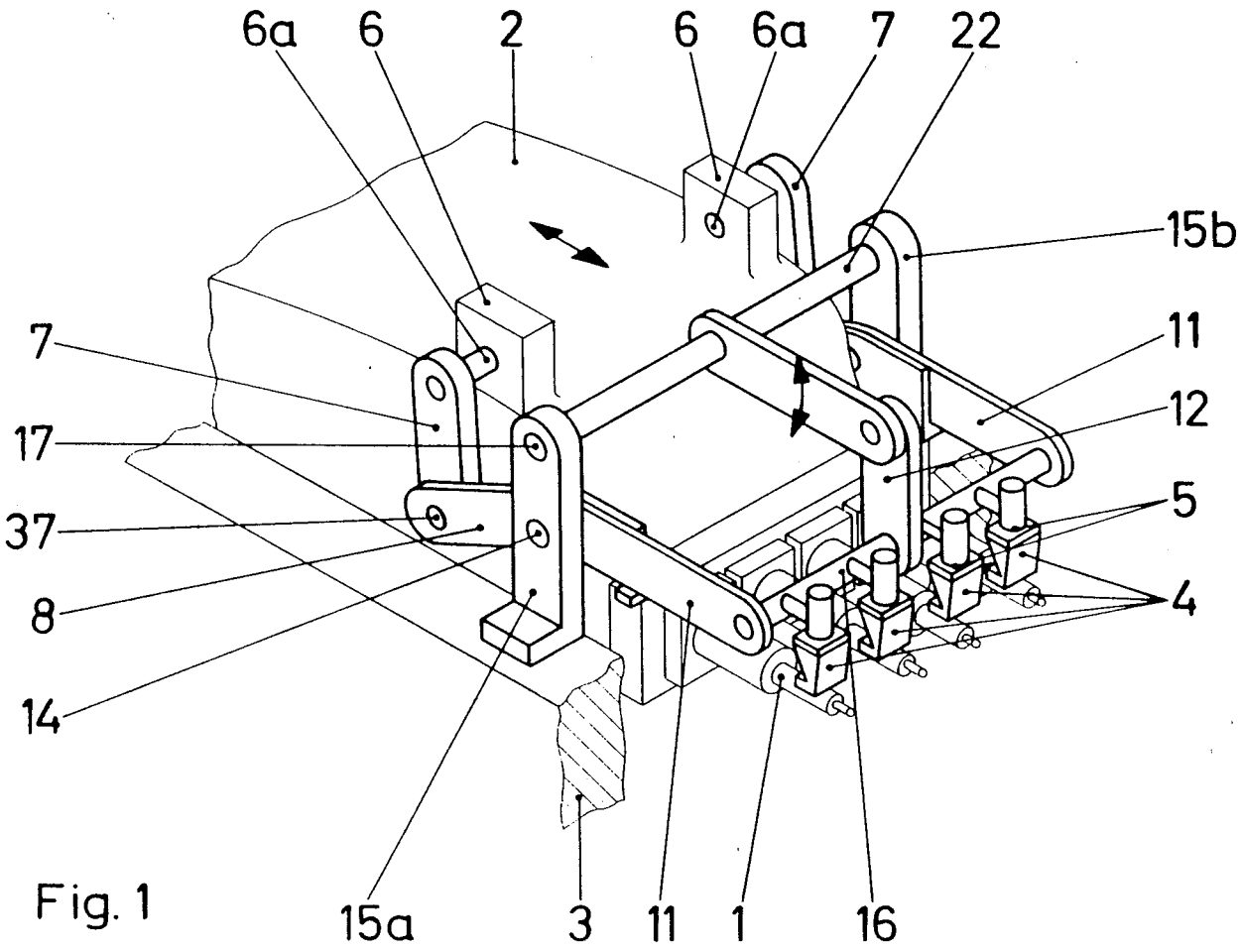

Such a device serves to continuously monitor the operation of a cross transfer press and is intended to determine, for example, whether a part has been caught on a punching tool after a working operation has been carried out. If this is the case, the device switches the press off immediately, so that so called "double loading" doesn't occur when a part to be worked subsequently is delivered. Moreover, such a device can also be used for monitoring the condition of the punching tool after every working stroke in order to likewise stop the press immediately, for example when a punch fracture is discovered. With control measures of this type, the press and the tools, even after a single malfunction, are protected from further consequential damage, for example caused by a punch fracture, and unnecessary scrap is thereby avoided in production. Finally, the device can also be used for the periodic cooling of the punching tools.

A safety device of the type defined at the outset is known from the German Patent Specification No. 29 07 464 (U.S. Pat. No. 4,333,329). In this device, a probing rocker, which is rotatably mounted about a horizontal axis, is driven in the working cycle of the press via a lever linkage control in such a way that, in the normal operation of the press, it is pivoted between a probing position, in which the press slide is located in its rear press slide position, and a waiting position in an upper lying area with respect to the working area of the press. The probing rocker supports the punch feelers allocated to the individual punches, the punch feelers are moved along during the corresponding pivoting movement and are passed in front of the front face of the respective punch in the working position of the rocker. If a part which has already been worked is still located on the punch during this procedure, the corresponding punch feeler strikes this part, as a result of which a functional fault is established and the press is immediately put out of operation. In this known device, provision is also made for cooling the punch end faces by means of cooling sprinklers provided on the punch feelers. The coolant used for this purpose is conducted to the individual cooling sprinklers by the tubular-made rocker arms. Moreover, the probing rocker, together with the punch feelers, can be swung up by means of a piston-cylinder unit into a position lying above the working area through which the rocker swings during normal operation, so that retooling, for example, can take place without being impaired by the safety device.

It is possible to use this known safety device in forming machines having a C body. If a forming machine has a closed frame as a body shape, relatively restricted space conditions predominate in particular in the probing or sensing area, which does not permit the known safety device, which requires a relatively spacious pivoting area, to be accommodated. Also, the probing rocker with the punch feelers must always be displaced about the rocker articulation axis on a circular path, as a result of which the punch feelers of the known device are fixed to a probing curve, the adaption of which to the punch geometry and movement causes problems. Because of the inadequate space relationships to the probing or sensing area, the probing curve on which the punch feelers are moved should in fact run past as flat as possible and as close as possible to the end faces of the punches, so that collisions cannot occur between the punch feelers and the punches and/or the cross transfer grippers. This requirement cannot be fulfilled satisfactorily even by modifying the known safety device, because conceptional limits are set by its functional principle.

Moreover, it is a disadvantage in the known safety device that, in the event of a worked part remaining on a punch, the entire weight of the safety device falls on this one part, which can damage the part, the tool and also the punch feelers.

In particular, the object of the invention, based on a device of the type defined at the outset, is to create a punch-feeler arrangement which, while avoiding the disadvantages of the known device, has a probing curve optimally adapted to the punch function, for the movement of the punch feelers and immediately becomes active in the event of a fault, with the tools and workpieces being subjected to minimum stress, and which is of relatively simple design and is reliable in use even when there are restricted space conditions in the probing or sensing area and with which it is possible to actuate and control all of the functions even from a control desk remote from the press.

The device according to the invention accordingly has a punch-feeler arrangement, the drive linkage of which is made as a parallel lever mechanism. In the drive linkage arrangement characterized according to the invention, since the lengths of the members in this parallel lever mechanism are approximately the same in pairs, the center guide link is guided approximately parallel to a connecting line, passing through the pivot bearings of the two guide links in the bearing pedestal arrangement, over a certain pivoting range of the upper and lower guide links. When the feeler lugs—and also the feeler surface of the punch feelers—have a corresponding parallel arrangement, the surface portions are shifted approximately rectilinearly perpendicular to the respective punch-displacement axes. The punch-feeler arrangement drive linkage designed according to the invention therefore displaces the punch feelers approximately rectilinearly, which are therefore moved on a probing curve which is so flat that the punch feelers can be accommodated without impairment even in the most restricted working areas of a forming machine. As a result of the virtually rectilinearly running punch-feeler movement, probing can also be carried out extremely close to the relative punch end faces, as a result of which reliable monitoring of the punch contour becomes possible. In addition, collision with the other parts of the machine, for example the cross transfer grippers, can be reliably avoided by the said rectilinear punch-feeler displacement. Moreover, the effectiveness of the cooling action which can be achieved via the coolant sprinklers can be decidedly increased by the small distance which can be maintained from the punch end faces during probing.

Since provision is made according to the invention to provide each punch feeler with an actuating element for a switch which puts the machine out of operation in the event of a fault, an exact indication of the location of the fault can be achieved via the actuating elements, to be put into function separately at each punch, for example via an indicating light for each punch feeler at a central control desk.

In this connection, it is particularly advantageous in the device according to the invention for the actuating element to be provided in the form of a transmission tube which is relatively displaceable at the punch feeler, is elastically preloaded into the probing or sensing area in its swing-in direction and interacts with the switch for stopping the machine. As soon as one of the punch feelers Strikes a part remaining on the punch, namely during the vertical swing-in movement of the punch feelers into the probing or sensing area, the elastic preloading yields and, as a result of the further movement of the punch-feeler arrangement, the punch-feeler lug, supported on the part, is pushed in the manner of a telescope into the punch-feeler housing. After a certain displacement distance, the abovementioned switch is put into function and the machine is immediately stopped. The elastically preloaded embodiment of the transmission tube ensures that, when the punch feeler strikes a workpiece, only a slight impact load is exerted on this workpiece and also on the entire drive linkage, so that the tool, the workpiece and also the punch-feeler arrangement itself are only subjected to minimum stress and in practice cannot sustain any damage.

If, according to a preferred embodiment, a proximity initiator is additionally provided in the punch feeler, the punch contour can be checked after every press stroke, a change in the tool condition can be indicated immediately and if necessary the machine can be stopped.

The punch-feeler swing-up drive provided in the device according to the invention is used for swinging up the entire punch-feeler arrangement by remote control and therefore for clearing the working area of the press for necessary retooling or repair. The holding device of the swing-up drive is located approximately in the press center above the press slide, and the drive engages from there on the upper guide link of the drive linkage. The swing-up drive is advantageously provided with drive means which can be actuated by remote control, so that swing-up movement of the punch-feeler arrangement and subsequent lowering can also be included in the largely automatic sequence of the press operation. The arrangement of the swing-up drive in the machine center offers the advantage that no disadvantageous torsion can act on the drive linkage.

Figure 2A:
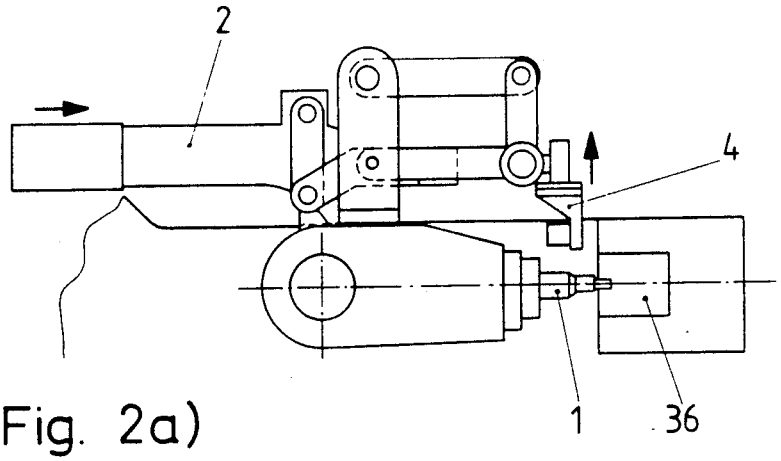
Figure 2B:
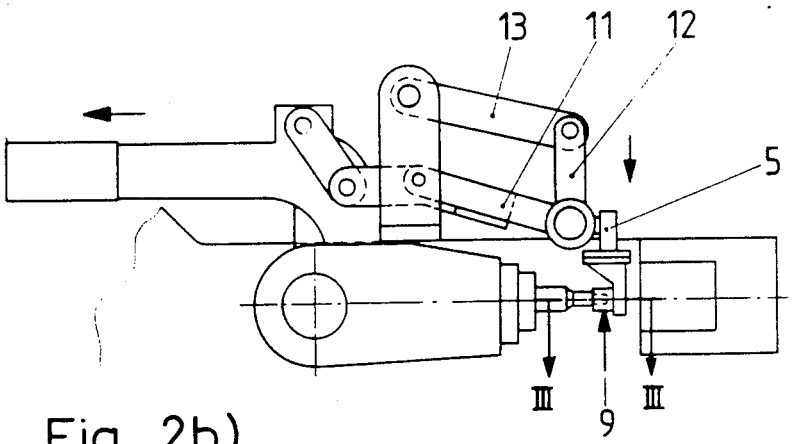
Figure 3A:
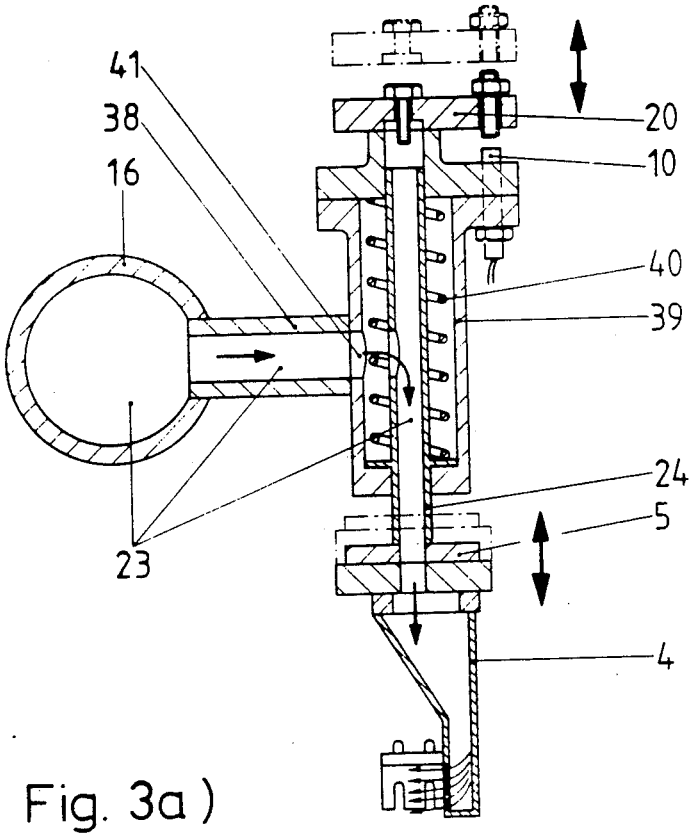
Figure 3B:
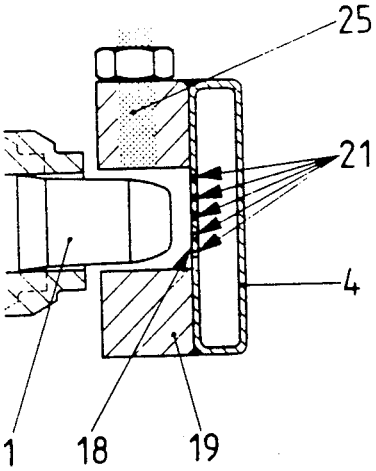
Figure 4A:
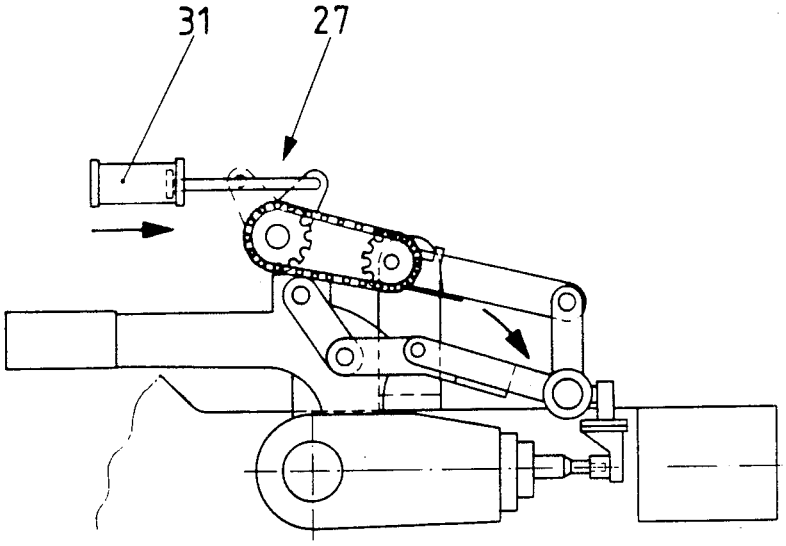
Figure 4B:
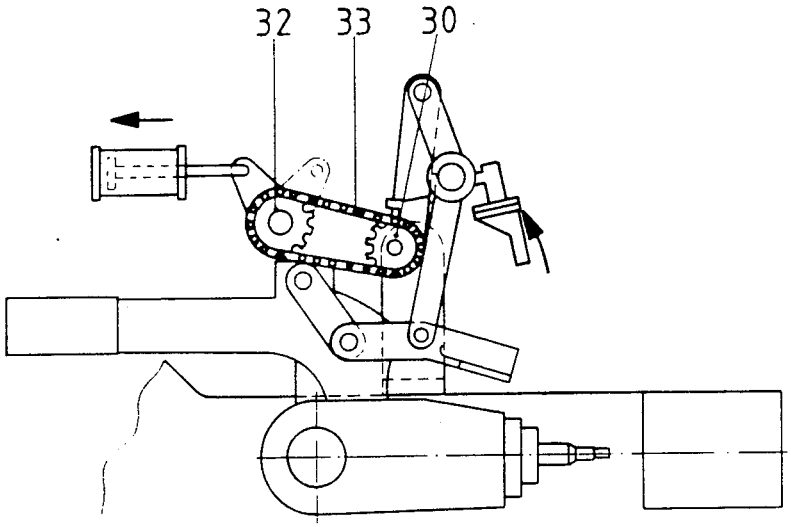
Figure 5A:
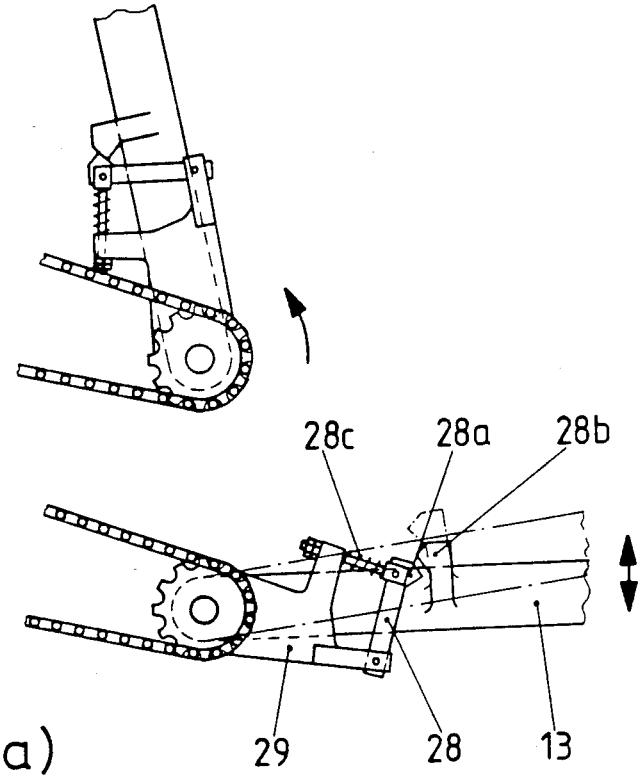
Figure 5B:
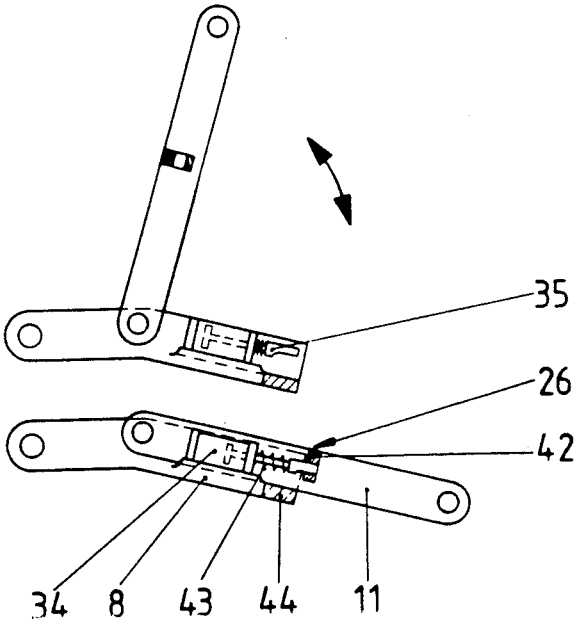

Further advantages of the device according to the invention are described in greater detail below in connection with the description of a special exemplary embodiment and with reference to drawings, in which:

FIG. 1 shows a perspective diagrammatic view of a punch-feeler arrangement in the upper operating position according to the features of the invention, which punchfeeler arrangement is attached to a front portion of a cross transfer press, FIG. 2 shows two diagrammatic side views of the punch-feeler arrangement according to FIG. 1 in the upper (FIG. 2*a*) and lower (FIG. 2*b*) operating position, FIG. 3*a* shows an enlarged longitudinal-section representation of a punch feeler with a part of a feeler holding device of the punch feeler arrangement according to FIG. 1, and FIG. 3*b* shows a diagrammatic cross-section through a punch feeler along the line III—III in FIG. 2*b*, FIGS. 4*a* and 4*b* show a diagrammatic side view of the punch-feeler arrangement similar to the representation in FIG. 2, having a swing-up drive, engaging on a drive linkage of the punch-feeler arrangement, for displacing the drive linkage into the position shown in FIG. 4*b*, FIG. 5*a* shows two schematic views of a detail of the swing-up drive according to FIGS. 4*a* and 4*b* in order to clarify the function of a locking arrangement, and FIG. 5*b* shows two diagrammatic views of the two-piece lower guide link of the drive linkage according to FIG. 1 in order to illustrate the functional mode of a guide link locking device.

According to the schematic representation in FIG. 1, a press slide 2 is displaceably mounted in sliding manner in a press frame 3 and is periodically moved by means of a drive (not shown) in the direction of the double arrow drawn on the press slide. Four punches 1 are attached to the front side of the press slide 2, opposite punches 1 are provided forming dies 36, as indicated in FIG. 2, which interact in known manner with the punches 1.

A punch drive is provided above the front-side end of the press slide 2, which punch drive is supported on a bearing pedestal arrangement 15, attached to the press frame 3, and is automatically actuated with the press slide movement via a lever control. This lever control is formed from a lever joint which is provided in mirrorinverted manner on both sides of the press slide and is formed in each case from a coupler 7 and a pivot axis 6*a* engaging into a press slide extension 6. The couplers 7 are in each case connected to the guide link portion ends via a pivot bearing 37.

The punch feeler arrangement 4 has a drive linkage which is formed from guide links coupled to a parallel-lever mechanism. As is apparent from FIG. 1, two two-piece lower guide links 8 and 11 are coupled in lower pivot bearings 14 to bearing pedestals 15 and 15*b* which are in alignment with one another and, with respect to the press slide 2, are attached opposite one another on the press frame 3. As is apparent in particular from FIG. 2, when the press slide 2 is in each case displaced in the arrow directions shown in FIG. 2, the lower guide links 8 and 11 are synchronously shifted by the lever control 6, 6*a* and 7 about the lower pivot bearings 14 between the end pivoting positions shown in FIG. 2. A feeler support 16 is mounted in pivotably movable manner between the ends of the lower guide links 8 and 11 facing toward the punch end faces, which feeler support 16, according to FIG. 1, supports a row of four punch feelers 4 located next to one another which are firmly connected in each case to the feeler support 16 via a feeler holding device 5 and have feeler lugs 19, with the punch feelers being aligned, approximately perpendicular to the punch displacement direction, in a manner projecting inward into the probing or sensing area 9 indicated in FIG. 2 between the punches 1 and the forming dies 36.

As is again apparent from FIG. 1, a center guide link 12 is located at half the transverse distance between the ends of the lower guide links 11, which center guide link 12 is attached non-rotationally to the feeler support 16 and, at its end opposite this connecting location, is connected in articulated manner to an upper guide link 13 which runs approximately parallel to the lower guide link 11. The upper guide link 13, at about half the distance between the bearing pedestals 15*a* and 15*b*, is connected non rotationally to a pivot shaft 22 which is rotatably supported in upper pivot bearings 17 of the bearing pedestal arrangement 15. As shown in FIG. 2, the drive linkage, consisting of the guide links 11, 12 and 13, is driven in such a way during corresponding displacement of the press slide that the guide links 11 and 13 are pivoted about their pivot bearings 14 and 17 at the bearing pedestal arrangement; but on the other hand the center guide link 12, the feeler support 16 and thus the punch feeler 4 experience a shifting movement, as indicated by the perpendicular arrows in FIG. 2, which runs parallel and approximately rectilinearly and also perpendicularly to the punch displacement direction. The upper representation in FIG. 2 shows the punch 1 in a front press-stroke end position, whereas the lower representation schematically indicates the rear press-stroke end position. When the punch 1 is located in the rear press-stroke end position, the punch feeler 4 enters into the probing or sensing area 9, so as to be able to sweep past as close as possible to the punch end face (cf FIG. 3*b*). The functionally essential course of the parallel guidance of the punch feeler 4, which parallel guidance takes place approximately vertically to the punch movement, is therefore approximately limited to the possible displacement section, shown in FIGS. 2, of the drive linkage 13, for which reason the movement sequence shown there approximately reproduces the punch-feeler displacement executed during the normal operation of the press.

It can be seen from FIG. 3*a* that the punchfeeler housing 39, which is connected to the feeler support 16 via a laterally projecting connecting tube 38, is made hollow in its inside and, in its inner space, has a transmission tube 24 enclosed by a spring 40. At the ends of the feeler housing 39, which ends are the upper and lower ends according to FIG. 3*a*, the transmission tube 24 is sealed in a manner such that it is capable of sliding and has a lateral wall opening 41 which opens its inner space to the connecting tube 38. The punch feeler 4 is screwed onto the lower end of the transmission tube 24, which punch feeler 4, as also shown in FIG. 3*b*, has a hollow housing portion which is rectangular in cross-section and, in the longitudinal section, according to FIG. 3*a*, narrows in an approximately wedge shape. This housing portion, at its feeler face 18, which according to FIG. 3*b* is opposite the punch 1, has a multi-hole coolant delivery sprinkler 21, through which coolant is fed in the direction of the arrows drawn in FIG. 3*a* through channels 23, formed by the connecting tube 38, the transmission tube 24 and the housing portion, and is sprayed onto the end face of the punch feeler. FIG. 3*b* shows feeler lugs 19 which are attached laterally to the punch feeler and which are guided around the front part of the punch on both sides of the latter. A proximity initiator 25 is located in the upper lateral feeler lug 19 in FIG. 3*b*, which proximity initiator 25 monitors the surface and punch-contour condition and acts as an actuating element for stopping the machine when discrepancies from the normal condition of the punch are found. The restricted enclosure, which can be seen in FIG. 3*b*, of the punch front part permits reliable probing of even the smallest parts remaining on the punch, and also permits a correspondingly reliable sensing of the punch contour for perfect surface condition and also for a restricted cooling space, which enables a high cooling effect to be achieved. Guiding the punch feeler 4 closely up to the punch end face in this manner, because of the described parallel guidance of the punch-feeler drive, can be realised during normal operation of the press, since the probing and sensing movement, as stated, can be executed virtually rectilinearly and vertically to the punch movement.

On the end of the transmission tube 24, which end is the upper end according to FIG. 3*a*, is located an actuating element 20 which actuates a switch 10 when the transmission tube is moved upward, which serves to switch off the machine. If a workpiece or a part of a workpiece should still be located on the punch visible in FIG. 3*b* during the downward movement of the punch feeler 4, the punch feeler, with its lug 19, strikes this part, and, as a result of the further punch-feeler downward movement produced by the drive linkage 11, 12 and 13, the transmission tube 24 moves relative to the feeler housing 39 against the preloading by the spring 40, and the switch 10 is actuated after a travel which can be preset at the actuating element 20, which switch 10 ensures that the machine is immediately stopped, that is, switched off and braked. The pre-tension force of the spring 40 is selected such that, when there is reliable preloading of the punch feeler 4, a load which is as small as possible is exerted on the punch 1 provided with a workpiece, as a result of which both the punch and the entire punch-feeler drive are subjected to as little impact stress as possible. The transmission tube 24 (FIG. 3*a*), at its inside, is connected to the feeler support 16 which is also made in a tubular shape and to which is connected a central coolant feed (not shown).

In order to form the punch working area such that it is easily accessible, for example for retooling, the punch-feeler arrangement has to be shifted out of this working area. The attachments schematically shown in FIGS. 4 and 5 are provided for this purpose. FIG. 4*a* shows a punch-feeler swing-up drive 27 which is made as a chain drive mechanism and is formed from a dog 29 engaging on the upper guide link 13, a chain wheel 30 sitting on the pivot shaft 22, a hydraulic drive 31 connected to a second chain wheel 32, and a roller chain 33 coupling both chain wheels. Because of the positive coupling between the press slide 2 and the lower guide links 11 via the lever control 6, 6*a* and 7*a*, it is necessary, for an upward swinging movement, to neutralise the drive action momentarily. For this purpose, the lower guide links 11 are divided into two guide link portions 8 and 11 (FIG. 5*b*) which are pivotable relative to one another on a pivot axis in the lower pivot bearing 14. In normal operation of the press, these two guide link portions 8 and 11 are arrested against a relative pivoting movement by a locking mechanism. This locking mechanism 26 comprises a hydraulic piston-cylinder unit 34 which is attached to the guide link portion 8, can be actuated by remote control, and carries a locking latch 35 at its free piston end, which locking latch 35 engages into a latching catch 42, correspondingly arranged on the guide link portion 11, and locks the two guide link portions 8 and 11 to one another as shown by the lower illustration in FIG. 5*b*. A spring 43 which acts on the locking latch 35 in the engagement direction is shown in the illustration. In this case, the piston-cylinder unit 34 is single acting, but it can also be made as a double-acting unit, in which case the spring 43 could be omitted. In this connection, the remote control capability of the piston-cylinder unit 34 is of particular importance. For this purpose, hydraulic lines (not shown) are connected which can be operated from a central control desk, so that it is not necessary to directly manipulate the punch-feeler arrangement in order to unlock and lock the lower guide links 8/11.

The punch-feeler arrangement, when the lower guide links 8 and 11 are unlocked, is swung up from the position according to FIG. 4*a* into the position according to FIG. 4*b* by actuating the hydraulic cylinder 31, preferably made double acting, the piston of which drives the chain drive mechanism via a pivot lever, so that the drive linkage 11, 12 and 13 and therefore also the punch feelers 4 can be swung up by the dog 29 about the pivot axes 14 and 17 into the position shown in FIG. 4*b*.

A locking arrangement 28 shown in FIG. 5*a* is used to secure the swung-up position according to FIG. 4*b*, which locking arrangement 28 is provided on the dog 29 and interacts with an arresting lug 28*b* which is fixed on the upper guide link 13. The locking arrangement 28 has a latching lock 28*a* which is preloaded by a spring 28*c* in the direction of the arresting lug 28*b* and is supported in a limited pivotable manner on the dog 29. Before the punch-feeler arrangement is actually swung up, the latching lock 28*a*, after a short initial turn of the swing-up drive 27 from the position shown in the lower representation according to FIG. 5, halts beyond the arresting lug 28*b* and, held by the spring 28*c*, remains bearing against the arresting lug surface, which surface is the upper surface in the representation, so that the upper guide link 13 is held between the dog 29 and the latching lock 28*a*, as shown at the top in the upper representation according to FIG. 5*a*. As soon as the dog 29 bears against the lower edge of the upper guide link 13 during the course of the upward swinging movement, it takes the latter with it into its swung-up position, and when this is reached the upper guide link 13, as can be seen from FIG. 5*a* at the top, is prevented from tilting further to the rear via the locking arrangement 28, so that the punch-feeler arrangement can reliably remain in the swung-up position shown in FIG. 4*b*. After the drive linkage has swung back into the position shown in FIG. 4*a*, the lower guide link portions 11 strike the stops 44, which can be seen in FIG. 5*b*, on the guide link portions 11 and thereby limit the return swinging movement of the drive linkage. In this position of the linkage, the chain drive mechanism of the swing-up drive is still in operation and turns the dog 29 slightly further when the upper guide link 13 is already stopped, so that the latching lock 28*a* slides over the arresting lug 28*b* and comes to a stop approximately in the position shown at the bottom in FIG. 5*a*. The upper guide link 13 is now freely movable for the probing movement controlled by the press slide 2 and is displaced in the manner described as a part of the drive linkage after the lower guide links 8/11 are accordingly locked via the locking mechanism 26.

The hydraulic cylinder 31 can also be actuated by remote control and is connected for this purpose to the central control desk via control lines (not shown). The control measures made possible by the hydraulic cylinderpiston units 34 and 31 enable the punch-feeler arrangement to be swung up and back to any press slide position, so that, during all fault conditions possible throughout an operating sequence, the punch-feeler arrangement can always be swung up and therefore the working area can be cleared for the measures necessary to rectify the fault.

In the exemplary embodiment described, four punches are shown located next to one another, with in each case a punch feeler of the same construction being allocated to a punch. This arrangement can of course vary, so that the punch-feeler arrangement can also be used for cross transfer presses having more or less punches and can also be used with punch feelers of different construction. For example, the final forming station in the course of manufacture, instead of having a punch feeler, could have a separating spade which extends the channels of an appropriately arranged discharge chute in such a way that a finished part is always brought into a discharge chute channel provided for it.

I claim:

1. A punch probing device for monitoring the condition of a punch and detecting the presence of foreign matter in a punching operation, wherein said punch probing device includes a press frame, a press slide having a leading edge and being displaceable on said press frame between an advanced position and a retracted position, at least one punch carried by said press slide and projecting forwardly from said leading edge thereof, at least one punch feeler associated one with each said punch, a feeler holding device supporting each feeler, means for displacing each said feeler holding device in a plane substantially perpendicular to the plane of movement of said punch slide between a probing position in which the feeler carried thereby cooperates with the associated punch and a withdrawn position in which said feeler is lifted substantially perpendicularly out of cooperating probing association with said associated punch, said displacing means incorporating a plurality of links and supports therefor interconnected to form a linkage parallelogram, and switch means engagable by the feeler holding device proximate said withdrawn position to arrest operation of the press.

2. A punch probing device according to claim 1, wherein the linkage parallelogram includes spaced upright pedistals mounted on said press frame, a pair of aligned lower links pivotally mounted on each said pedestal towards the base thereof, at least one upper link pivotally mounted at an inner end on said pedestals and lying substantially parallel to said lower links, a feeler support interconnecting the ends of said lower links remote from the pivotal mountings thereof and a center guide link extending substantially parallel to said upright pedestals and being pivotally connected at one end to said outer end of said upper link and non-rotatably connected at the other end to said feeler support and wherein pivotal movement of said parallel linkage is controlled by a drive linkage having one end coupled to said lower links and an opposite end carried by and displaceable with the press slide.

3. A punch probing device according to claim 1, including fluid conduit means for feeding coolant fluid to the leading end of each punch.

4. A punch probing device according to claim 2, wherein a plurality of aligned punches project forwardly from the leading edge of the press slide and a plurality of aligned feelers are carried by the feeler support and arranged each to cooperate with one of said punches, wherein two pedestals upstand from the punch frame and straddle the displacable slide, said pedestals beings interconnected by a bridging pivot shaft mounted at opposite ends in aligned upper bearings on said pedestals and supporting at an intermediate location the inner end of a single upper link, and wherein the lower links are pivotally mounted in aligned lower bearings on said pedestals.

5. A punch probing device according to claim 4, wherein coolant delivery sprinklers are provided one in each feeler, said sprinklers being fed by supply channels extending through the feeler holding device.

6. A punch probing device according to claim 1, wherein the switch means is triggered by a spring biased tranmission tube connected to a feeler.

7. A punch probing device according to claim 4, wherein each lower guide link consists of two guide link portions which can be pivoted relative to one another on the bearing pedestal about the associated lower bearing, said guide link portions being prevented from pivotal movement relative to each other during normal operation of the press by means of a remote controllable locking mechanism, and wherein a punch-feeler swing-up drive and a locking arrangement for arresting the linkage parallelogram during the upward swinging movement are provided about the press slide proximate the connection between the upper link and the pivot shaft.

8. A punch probing device according to claim 7, wherein the punch-feeler swing-up drive is a chain drive mechanism including a first chain wheel coupled to a dog engaging on the upper link, a second chain wheel actuatable by a remote controllable piston and cylinder unit attached in a fixed position on the press frame and a chain engaging around said first and second chain wheels, and wherein the locking arrangement is formed from an arresting lug on the upper link and a cooperating latching lock elastically preloaded against said arresting lug.

9. A punch probing device according to claim 7, wherein the remote controllable locking mechanism includes a spring biased locking latch carried by one of said lower link portions and arranged lockably to engage the other of said lower link portions, said latch being operable by a piston and cylinder control.

10. A punch probing device for monitoring the condition of a punch and detecting the presence of foreign matter in a punching operation, wherein said punch probing device includes a press frame, a press slide having a leading edge and being disposable on said press frame between an advanced position and a retracted position, at least one punch carried by said press slide and projecting forwardly from said leading edge thereof, at least one punch feeler associated one with each said punch, a feeler holding device supporting each feeler, means for displacing each said feeler holding device in a plane substantially perpendicular to the plane of movement of said punch slide between a probing position in which the feeler carried thereby cooperates with the associated punch and a withdrawn position in which said feeler is lifted substantially perpendicularly out of cooperating probing association with said associated punch, said displacing means incorporating a plurality of links and supports therefor interconnected to form a linkage parallelogram having spaced upright pedestals mounted on said press frame, a pair of aligned lower links pivotally mounted on each said pedestal towards the base thereof, at least one upper link pivotally mounted at an inner end on said pedestals and lying substantially parallel to said lower links, a feeler support interconnecting the ends of said lower links remote from the pivotal mountings thereof and a center guide link extending substantially parallel to said upright pedestals and being pivotally connected at one end to said outer end of said upper link and non-rotatably connected at the other end to said feeler support, each said lower guide link consisting of two guide link portions which can be pivoted relative to one another on the bearing pedestal, said guide link portions being prevented from pivotal movement relative to each other during the normal operation of the press by means of a remote controllable locking mechanism, switch means engagable by the feeler holding device proximate said withdrawn position to arrest operation of said press, and a punch-feeler swing-up drive and a locking arrangement for arresting the linkage parallelogram during the upward swinging movement are provided about the press slide proximate the connection between the upper link and a pivot shaft interconnecting said pedestals.

* * * * *